US005405087A

United States Patent [19]

Waryu et al.

[11] Patent Number: 5,405,087

[45] Date of Patent: Apr. 11, 1995

[54] NOZZLE CLEANING SYSTEM INCLUDING SPRAY GUN COVER FOR CAN COATING SYSTEM

[75] Inventors: Joseph C. Waryu, Amherst; Thomas A. Loparo; Guy H. McMillan, both of Elyria; Mark W. Norvotny, Avon Lake; Jeffrey M. Buckler, Stow, all of Ohio

[73] Assignee: Nordson Corporation, Westlake, Ohio

[21] Appl. No.: 222,421

[22] Filed: Apr. 4, 1994

Related U.S. Application Data

[63] Continuation of Ser. No. 875,922, Apr. 29, 1992, Pat. No. 5,344,073.

[51] Int. Cl.[6] ..... B05B 1/28; B05B 15/02

[52] U.S. Cl. ..... 239/288; 239/112; 239/121; 118/302

[58] Field of Search ..... 239/288–288.5, 239/104, 106, 112, 120, 121; 118/302, 306, 317, DIG. 10; 134/104.1

[56] References Cited

U.S. PATENT DOCUMENTS

| | | | |
|---|---|---|---|
| 1,147,933 | 7/1915 | Ford | 239/288 |
| 1,610,714 | 12/1926 | Smith | 239/288 |
| 1,988,979 | 1/1935 | Campbell | 239/288 |
| 2,161,131 | 6/1939 | Burger | 239/104 |
| 3,211,377 | 10/1965 | Brenner | 239/121 |
| 3,711,028 | 1/1973 | Hengesbach | 239/288.5 |
| 3,726,711 | 4/1973 | Hogstrom . | |
| 3,859,113 | 1/1975 | Horvath et al. . | |
| 3,876,144 | 4/1975 | Madden et al. | 239/106 |
| 4,378,386 | 3/1983 | Rehman . | |
| 4,767,056 | 8/1988 | Demetrius et al. | 239/288 |
| 4,814,794 | 3/1989 | Sato | 239/112 |
| 4,886,013 | 12/1989 | Turner et al. . | |
| 4,951,875 | 8/1990 | Devey | 239/104 |
| 5,078,325 | 1/1992 | Waryu et al. . | |

FOREIGN PATENT DOCUMENTS

| | | |
|---|---|---|
| 221622 | 5/1987 | European Pat. Off. . |
| 446120 | 9/1991 | European Pat. Off. . |
| 2366880 | 5/1978 | France . |
| 57-209668 | 12/1982 | Japan . |
| 58-074165 | 5/1983 | Japan . |
| 62-042668 | 9/1989 | Japan . |
| 390742 | 8/1965 | Switzerland . |
| 2079184 | 1/1982 | United Kingdom . |

OTHER PUBLICATIONS

"Electrostatic Guns Solve Problems at Singer Plant" by Ronald Massey, Furniture Manufacturing Management, Jan., 1980.

*Primary Examiner*—Karen B. Merritt
*Attorney, Agent, or Firm*—Howard M. Cohn

[57] ABSTRACT

An apparatus for cleaning a coating gun nozzle used in spraying the inner surface of cans with a coating material comprises a cleaning nozzle of a cleaning gun for spraying a cleaning solution onto the spray nozzle to remove oversprayed coating material collecting thereon. The cleaning nozzle is secured to an end of an elongated cleaning gun extension and is positioned above a spray nozzle secured to one end of a coating gun extension for Spraying cleaning solution onto said spray nozzle. Cover sleeves, forming liquid-tight seals with the cleaning and spray nozzles, have removable friction engagement with the cleaning and spray gun extensions to shield the cleaning and spray guns from oversprayed coating material. A control system controls the operation of the coating and cleaning guns.

8 Claims, 3 Drawing Sheets

12
32
30
23
14
$d_7$
20
46
42
44
40
38
36
48
29
$d_3$
50
$d_2$
$d_1$
22
34
102
16
18
10
103
105
101
104
26
107
$D_1$
74
24
73
108
76
$D_2$
106
109
$d_5$
51'
50'
$D_3$
78
48'
80
44'
42'
64'
28
29
46'
31
138
27

NOZZLE CLEANING SYSTEM INCLUDING SPRAY GUN COVER FOR CAN COATING SYSTEM

This is a continuation of application Ser. No. 07/875,922, filed on Apr. 29, 1992, now U.S. Pat. No. 5,344,073.

BACKGROUND OF THE INVENTION

The invention relates to a method and apparatus for protecting and cleaning a spray nozzle and spray coating gun used in a spray coating process.

In a conventional spray coating process for spray coating surfaces, such as the inner surface of cans, small particles of sprayed coating material adhere to the surface being sprayed and form a coating film. Some of the fine particles of coating material, however, do not adhere to the surface being coated and form a mist (called "overspray" herein) which floats in the vicinity of the spray apparatus. Some of the overspray sticks to the spray or coating gun and its spray nozzle and gradually accumulates to form a layer of coating material thereon. Sometimes, globs of the accumulated material fall into the spray and become a part of the coating on the surface being sprayed. These globs of coating material mar the appearance of the coated surface and can also cause a defect in the can when the globs do not cure in the allotted time.

Another problem caused by oversprayed coating material collecting on the spray nozzle is the partial blockage of the spray nozzle orifice and a resulting distortion in the spray pattern causing a portion of the sprayed surface to be left substantially uncoated.

To avoid these problems associated with oversprayed coating material, machine operators must periodically stop the coating process and clean the spray nozzle. In addition to having to periodically clean the nozzle, it is common for the operators to periodically coat the exposed surfaces of the spray gun, with the exception of the spray nozzle, with grease or animal fat to enable the gun to be more easily cleaned of overspray with a rag. Also, in some cases, card board spray shields have been placed on the spray gun body to prevent some of the overspray from accumulating on the spray gun. However, these spray shields are not only crude but become soggy and quickly loose their effectiveness. Moreover, these shields do not protect the nozzle and the portion of the gun barrel or extension closest to the nozzle which is of particular importance.

In a prior art system for cleaning spray nozzles, as disclosed in Japanese Document No. 62-42668 assigned to Nordson Corporation, there is described a method and apparatus for cleaning spray nozzles wherein a hood is installed at the base of the spray coating nozzle. However, this hood is spaced from the spray nozzle and does not prevent overspray from accumulating on the spray nozzle itself or on the portion of the gun barrel or extension closest to the nozzle. This prior art document also shows a solvent spray nozzle positioned above or alongside the spray coating nozzle to spray a solvent on the spray coating nozzle immediately after a specified number of coating operations are completed to rinse off oversprayed coating material. However, when fewer than the specified number of coating operations are completed, typically at the end of a production run, the solvent not sprayed onto the spray nozzle and the coating material can dry or skin over on the nozzle and clog it.

SUMMARY OF THE INVENTION

It is an advantage of the present invention to provide an apparatus and method of cleaning a spray gun and spray nozzle which obviates the disadvantages and limitations of the prior art devices.

It is a further advantage of the present invention to provide an apparatus and method of cleaning a spray gun and preventing oversprayed coating material from collecting on the spray gun and on an associated nozzle cleaning gun.

It is a still further advantage of the present invention to provide an apparatus and method of cleaning a spray gun wherein a control apparatus insures that the spray gun is cleaned after a predetermined number of on-off cycles and at the end of a production run.

It is a yet further advantage of the present invention to provide an apparatus and method of cleaning a spray gun wherein disposable, plastic sleeves are placed on the spray gun and, if desired, on an associated nozzle cleaning gun to prevent build up of the overspray coating material on the guns themselves.

In accordance with the invention, a cover sleeve is inserted onto the spray gun barrel or extension to protect the spray gun from overspray. The sleeve comprises an elongated, tubular body defining an internal passage having an annular inlet portion, an annular intermediate portion and an annular outlet portion. The annular inlet portion has a flange extending radially outward to shield the rearward portions of the spray gun from overspray.

In accordance with the invention, the cover sleeve is inserted on a spray gun having an elongated gun extension and a nozzle secured to a free end of the gun extension by a nozzle nut. The sleeve comprises an elongated tubular body defining an internal passage adapted to be in surrounding relationship with the gun extension. The tubular body includes an annular inlet portion having a flange extending radially outward to shield the rearward portions of the spray gun from overspray, an annular intermediate portion and an annular outlet portion equipped for removable, frictional engagement with the nozzle nut and having a liquid-tight seal engagement with the nozzle nut.

Further, in accordance with the invention, an apparatus for cleaning a spray nozzle of a coating gun is combined with a coating gun having a spray nozzle to spray the interior of a metal can. The apparatus comprises a cleaning spray gun having a cleaning spray nozzle device for spraying a liquid cleaning solution of solvent or water or, the spray nozzle of the coating gun to clean the spray nozzle of oversprayed coating. The apparatus also includes a device for cycling the coating gun on and off for spray coating the interior surfaces of cans which are conveyed past the coating gun; a device for cycling on the cleaning gun to spray a liquid cleaning solution from the cleaning spray nozzle device after a first predetermined period of time from the cycling off of the coating gun whereby the cleaning solution cleans off oversprayed coating material from the spray nozzle; a device for cycling off the cleaning gun after a second predetermined period of time; and a device for cycling on the cleaning gun after a third predetermined period of time from the cycling off of the coating gun whenever the device for cycling on the cleaning gun after a first predetermined period of time has not cycled on the coating gun within the third predetermined time period.

In accordance with the invention, a method for cleaning a spray nozzle of a coating gun for spray coating can interiors comprises the following steps. The first step is cycling on the coating gun to spray coat the can interior with the spray nozzle. The next step is cycling off the coating gun. This step is followed by cycling on a cleaning gun to spray and clean the spray nozzle with a liquid cleaning solution after a first predetermined period of time from cycling off the coating gun. The following step is cycling off the cleaning gun after a second predetermined period of time from cycling on the cleaning gun. A further step is cycling on the cleaning gun after a third predetermined period of time from the cycling off of the coating gun, whenever the step of cycling on the cleaning spray gun after a first predetermined period of time has not occurred within the third predetermined time period.

In accordance with the invention, an apparatus for cleaning a spray nozzle is combined with a spray gun having an elongated spray gun extension with a spray nozzle secured to one end for spraying a can interior with a coating material. The apparatus comprises a cleaning gun device for spraying a liquid cleaning solution on the spray nozzle of the spray gun whereby oversprayed coating material is cleaned from the spray nozzle. The cleaning gun device includes a cleaning gun having an elongated cleaning gun extension and a cleaning nozzle secured to one end thereof for spraying a cleaning solution of solvent or water onto the spray nozzle. A first cover sleeve comprises an elongated, tubular body defining an internal passage adapted to be in surrounding relationship with the cleaning gun extension to shield the rearward portions of the cleaning gun from oversprayed coating material. A second cover sleeve comprises an elongated, tubular body defining an internal passage adapted to be in surrounding relationship with the coating gun extension to shield the rearward portions of the coating gun from oversprayed coating material.

DETAILED DESCRIPTION OF THE DRAWINGS

The structure, operation, and advantages of the present preferred embodiment of the invention will become further apparent upon consideration of the following description taken in conjunction with the accompanying drawings, wherein.

DETAILED DESCRIPTION OF THE INVENTION

Figure 1:
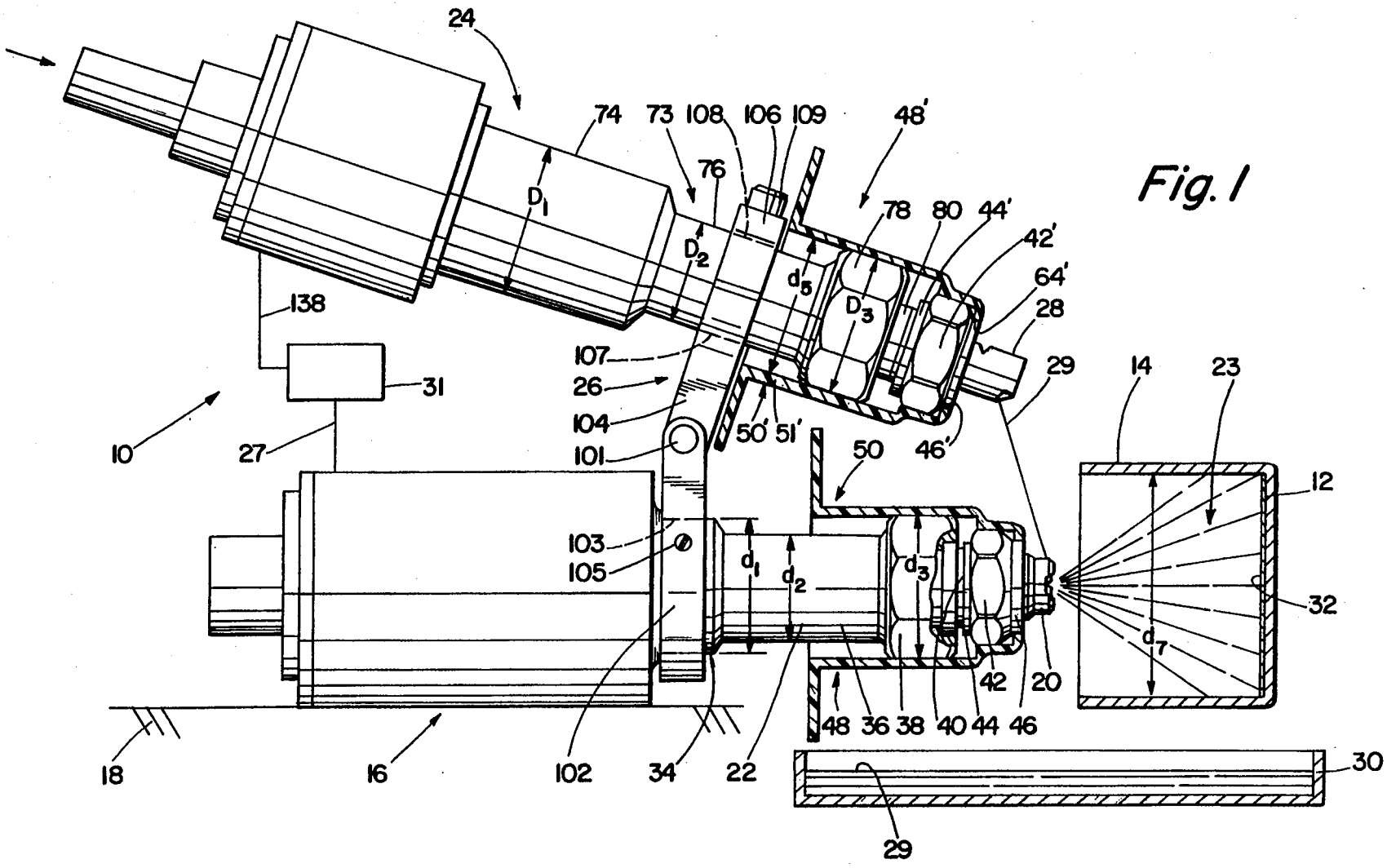
FIG. 1 is an elevational view of a spray gun system for coating a can interior including a nozzle cleaning gun adjustably secured to a coating gun for spraying a cleaning solution onto the nozzle of the coating gun.
Figure 2:
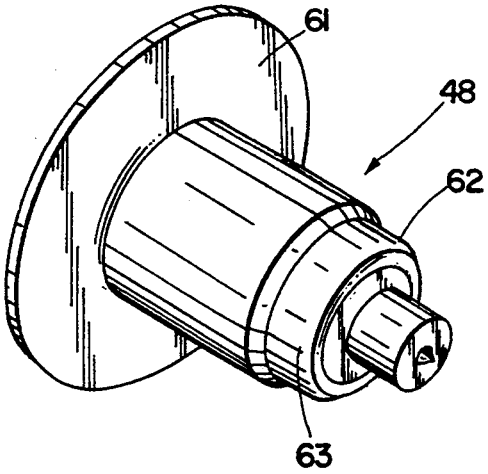
FIG. 2 is a perspective view of a cover sleeve adapted to protect a coating gun and/or a cleaning gun from overspray.

Referring to FIG. 1, there is illustrated an elevational view, partly in cross section, of a spray gun system 10 for spray coating a surface, such as the inside bottom surface 12 of a can 14 with a spray or coating gun 16. Obviously, coating gun 16 could alternatively coat the inside wall of can 14 or even simultaneously coat the inside wall and the bottom of can 14 such as is shown in prior art, U.S. Pat. No. 3,637,313 (FIG. 18), with can 14 being rotated. Spray gun 16 could be of any known design, but preferably would be like that shown in U.S. Pat. No. 5,078,325 which is hereby incorporated by reference in its entirety. The cans are positioned in front of the spray gun and rotated as required by a drive apparatus (not shown), such as the apparatus in JP 62-42668. The spray gun system 10 includes a spray or coating gun 16 mounted to a support base 18. Spray gun 16 includes a spray nozzle 20 mounted to one end of a spray gun extension 22 for directing a spray coating material 23 into the can 14. A nozzle cleaning gun 24 is adjustably mounted adjacent to coating gun by a mounting bracket 26. The cleaning spray gun 24 has a cleaning spray nozzle 28 mounted at one end for spraying a liquid cleaning solution 29, such as water or solvent, onto the spray nozzle 20 of the spray gun 16 to keep the spray nozzle clean of oversprayed coating material. A collection trough 30 is positioned below the spray nozzle 20 to collect the cleaning solution and the washed off coating material from the spray nozzle timing control system 31 is connected by lines 27 and 138, preferably electrical, to the coating gun 16 and the cleaning gun 24, respectively, for cycling them on and off.

The spray coating gun 16 has an inlet port (not shown) connected to a supply of coating material by any conventional means, such as a hose. The coating gun 16 can be cycled on and off by any desired means, such as the timing control system 31 at any predetermined time. For example, the spray gun can be cycled on whenever a can is positioned in front of the spray nozzle 20. Coating gun 16 includes a spray nozzle extension 22 having a first end portion 34 of a first diameter $d_1$, a middle portion 36 of a second diameter $d_2$, a retaining nut 38 (such as but not limited to a hexagonal nut) with a length $d_3$ across oppositely disposed corners and an outlet end 40 extending outward from the retaining nut 38. A spray nozzle 20 is secured to the outlet end 40 in sealing relation by a nozzle nut 42. The nozzle nut 42 is preferably a hexagonal nut with cylindrical shoulders 44 and 46 each having a diameter $d_4$ and disposed at opposite ends thereof. However, it is within the scope of the invention to provide nozzle nuts with other shapes, such as octagonal.

Referring to FIGS. 1, 2, 3, 3A & 3B, there is illustrated a cover sleeve 48 to protect the spray coating gun 16 and spray nozzle 20 from overspray. The sleeve 48 is constructed of an elongated tubular body 50 defining an internal passage 52. The body 50 has an outer surface 53 and inner surface 55 spaced so that the cover sleeve has a generally uniform wall thickness of about 0.020 to about 0.040 inches. Note preferably, the wall thickness is about 0.027 to about 0.033 inches. While the wall thickness is adequate to provide a sturdy sleeve that can withstand the rigors associated with the spraying of coatings during the manufacture of cans, it is thin enough so that the cover sleeve is inexpensive and disposable. Preferably, the tubular body comprises a material selected from the group comprising polyethylene and polypropylene.

The tubular body 50 includes an elongated, annular inlet portion 59 having an internal diameter $d_5$ which is slightly larger than the length $d_3$ across opposite edges of the retaining nut 38 on spray extension 22 to provide a slight clearance therebetween.

At one end 57 of the sleeve, the internal passage 52 forms the annular inlet portion 59 having a flange 61 extending radially outward therefrom to shield the rearward portions of the spray gun from overspray. The outer diameter $d_6$ of the flange 61 is in the preferred embodiment at least the size of the internal diameter $d_7$ of the cans being sprayed. It is believed that using a cover sleeve 48 with a flange diameter $d_6$ less than the size of the inner diameter $d_7$ of the can will not adequately shield the spray gun from overspray.

Figure 3B:
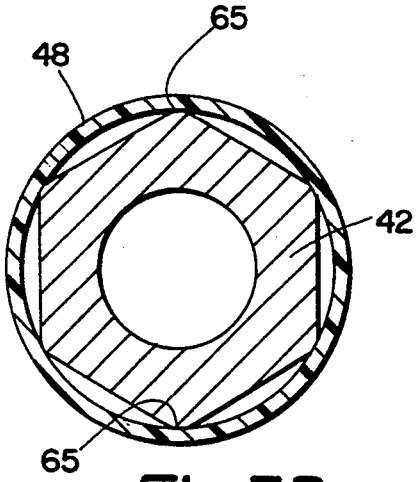
FIG. 3B is a sectional view through a line 3B—3B of FIG. 3.
Figure 3A:
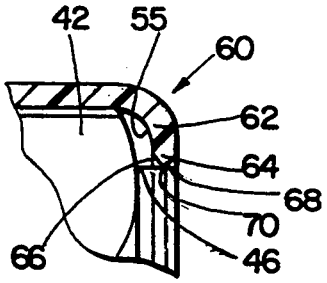
FIG. 3A is an exploded sectional view of the seal formed between the sleeve and the nozzle nut of FIG. 3.
Figure 3:
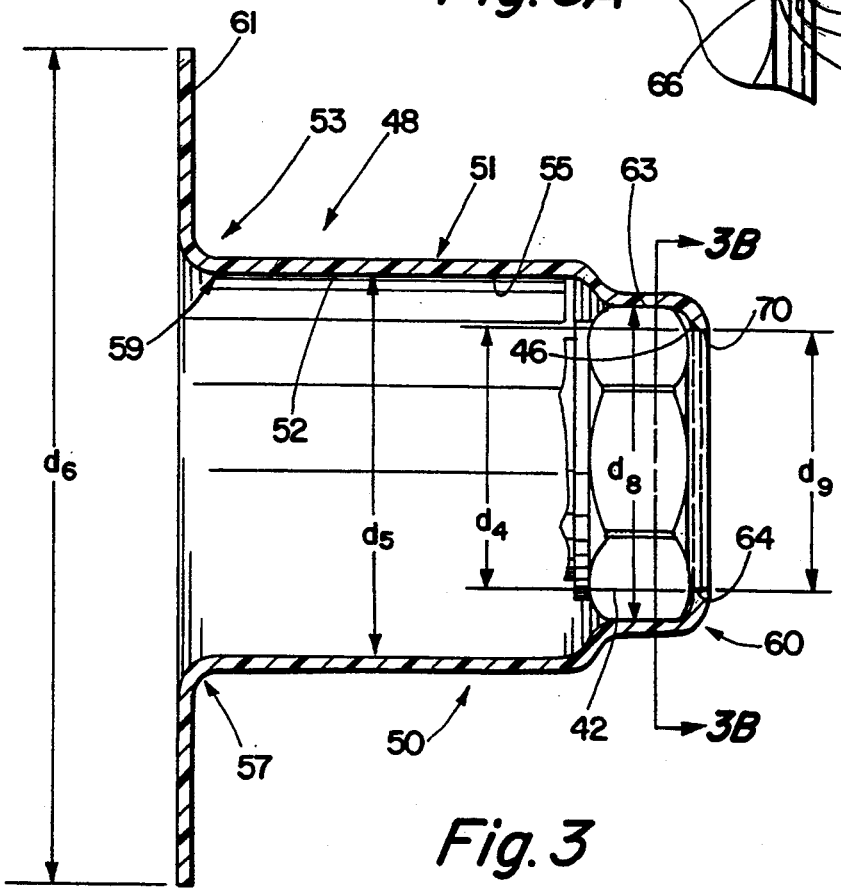
FIG. 3 is a cross sectional view through the cover sleeve showing the cover sleeve engaging the nozzle retaining nut of the coating gun.

The sleeve 48 has an elongated, annular intermediate portion 63 having an internal diameter $d_8$ which is less than the diameter $d_5$. The internal diameter $d_8$ is slightly less (about 0.020 to about 0.030 inches) than the distance between opposite corners 65 of the hexagonal nozzle nut 42, as seen in FIG. 3B, for removable frictional engagement with the nozzle nut 42. That is, the intermediate portion 63 of sleeve 48 is pressed axially onto the hexagonal nut 42 of spray nozzle 20 in order to secure the cover sleeve to the spray gun.

The sleeve 48 has an annular outlet portion 60 formed into an inwardly curved lip 62 having a free end 64 with a diameter $d_9$. The diameter $d_9$ of the free end is slightly less (about 0.005 to about 0.010 inches) than the diameter $d_4$ of the annular shoulder 46 of nozzle nut 42 for fluid tight sealing engagement therewith. To further enhance the effective sealing of the sleeve end 64 with the shoulder 46, the free end has chamfered surface 66, see FIG. 3A, between the inner surface 55 and a cylindrical edge surface 68. When the sleeve is pressed axially onto the hexagonal nut, the edge 70 at the intersection of the chamfered edge 66 and the cylindrical surface 68 has a tendency to flare slightly outward away from the hexagonal body of the nut and form a liquid-tight sealing fit against the shoulder 46.

The nozzle cleaning spray gun 24, as illustrated in FIG. 1, can be of any conventional design suitable for spraying a liquid cleaning solution 29 onto the spray nozzle 20 to wash off and prevent any accumulation of oversprayed coating material thereon. If the coating material is water based, the cleaning solution will be water. If the coating material is solvent based, the cleaning solution will be solvent. The cleaning gun has an inlet port connected to a supply of liquid cleaning solution by any conventional means, such as a hose. The cleaning spray gun 24 includes a spray nozzle extension 73 having a first end portion 74 of a first diameter $D_1$, a middle portion 76 of a second diameter $D_2$ and a retaining nut 78 (such as an hexagonal nut) with a length of $D_3$ across oppositely disposed corners. An outlet end 80 extends outward from the retaining nut 78. A cleaning spray nozzle 28 is secured to the outlet end 80 in a sealing relation by a nozzle nut 42'. Throughout the specification, where elements are substantially identical, prime numbers are used to indicate like elements having unprimed numbers. The nozzle nut 42' includes cylindrical shoulders 44' and 46' at the opposite ends thereof.

Figure 4:
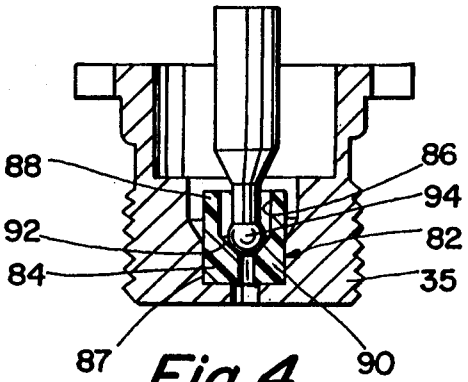
FIG. 4 is an enlarged, cross sectional view of a first embodiment of a soft seat incorporated in a seat housing of a cleaning gun.

Referring to FIG. 4, there is illustrated a seat 82 within a seat housing 35 which extends from outlet end 40 of the spray nozzle extension. Seat 82 is constructed of a generally tubular body 84 defining an internal passage 86. The seat 82 is secured within a bore 87 of the seat housing 35 by any means such as a press fit. An elongated inlet section 88 of the seat 82 has a larger inner diameter than the inner diameter of an elongated outlet section 90. A chamfered surface 92 between the inlet and outlet sections forms a valve seat for a valve end 94. In cleaning gun 24, the seat 82 is preferably constructed of a soft material, such as a plastic material like nylon. A soft material is particularly advantageous when the cleaning solution is water. Often, water is corrosive and because of its low viscosity has poor lubricity. The soft material wears longer under these operating conditions as compared with a typical prior art seat made of a carbide material.

Figure 5:
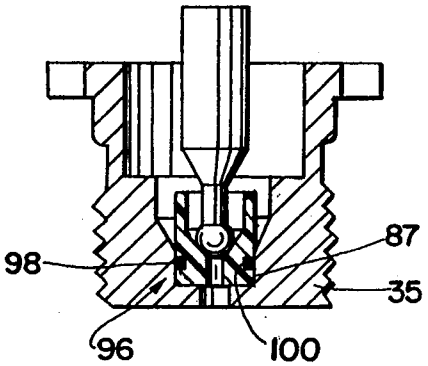
FIG. 5 is an enlarged, cross sectional view of a second embodiment of a soft seat incorporated in a seat housing of a cleaning gun.

Referring to FIG. 5, there is illustrated a second embodiment of a seat 96 within a seat housing 35 of cleaning gun 24. The seat 96 is substantially identical to seat 82 except for an o-ring seal 98 disposed within a groove 100. The seal prevents leakage between the seat 96 and the bore 87 of the seat housing 35.

Referring to FIG. 1, there is illustrated a cover sleeve 48' to protect the nozzle cleaning gun 24 from overspray. The cover sleeve 48' is pressed axially onto the nozzle nut 42'. The free end 64' flares slightly outward and forms a liquid-tight sealing fit against the shoulder 46' of the nozzle nut.

The tubular body 50' of sleeve 48' has an elongated, annular inlet portion 51' having an internal diameter $d_5$. The internal diameter $d_5$ of the elongated portion 51' is slightly larger than the diameter $D_3$ of the retaining nut 78 of cleaning extension 73 to provide a slight clearance therebetween.

Cleaning spray gun 24 is adjustably mounted adjacent to the spray gun 16 by a mounting bracket 26. The bracket 26 includes a mounting arm 102 which is adjustably secured about the first portion 34 of the spray extension 22. For example, the mounting arm 102 can have a cylindrical bore 103 extending therethrough which enables the arm to be rotated about the cylindrically shaped portion 34 to a desired position. Moreover, the mounting arm 102 can be moved in a longitudinal direction towards or away from the middle portion 36. Securing means 105, such as set screws, affix the arm 102 to the portion 34 in the desired location. Bracket 26 also includes a cleaning gun mounting arm 104 which is pivotally secured at one end to mounting arm 102 by any desired means such as a bolt 101. Mounting arm 104 can include a substantially semicircular, upwardly facing surface 107 upon which the middle portion 76 of the nozzle extension 73 is supported. A strap 106, having a semicircular, inwardly facing surface 108, can be placed about the portion 76 and secured to the mounting arm 104 by means such as bolt 109 to locate the cleaning gun 24 in a desired position with respect to the coating gun 16.

The cleaning spray gun 24 can be positioned above or along side the spray gun 16 by adjusting the bracket 26 proper positioning enables the liquid cleaning solution 29 being sprayed from cleaning spray nozzle 28 to be directed against the spray nozzle 20 of the coating gun 16. The cleaning solution washes the spray nozzle 20 and keeps it clean of any oversprayed coating material, Referring to FIG. 1, a collection trough 30 is illustrated as positioned below the spray nozzle 20 to collect the cleaning solution and any of the coating material which is washed away during the spraying of the spray nozzle 20 with cleaning solution 29 from the cleaning nozzle 28. The collection trough 30 is positioned on the opposite side of the spray gun with respect to the nozzle cleaning gun 24 so all of the liquid rinsed off of the nozzle 20 is collected therein.

Figure 6:
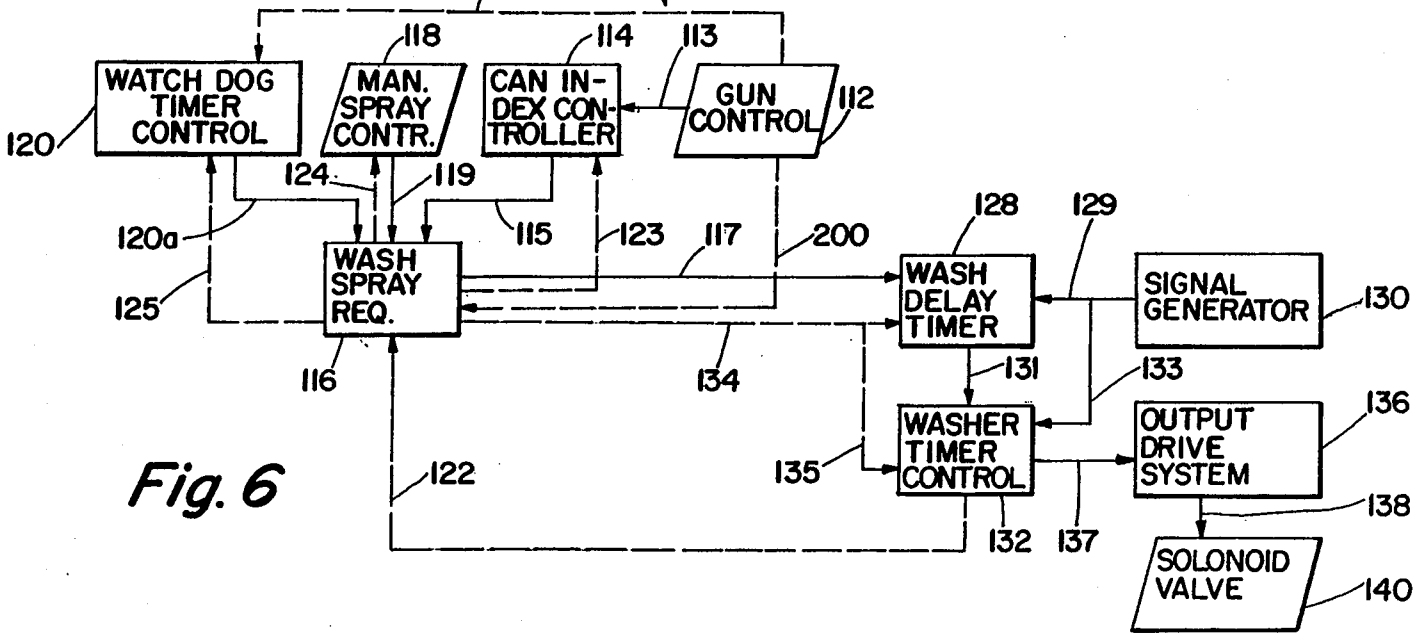
FIG. 6 is a schematic view of a control system for operating the coating gun and nozzle cleaning gun of the present invention.

Referring to FIG. 6, there is illustrated a block diagram of a nozzle cleaning system controller 31. Typically, the entire system controller will be provided on a single board. Gun control signal controller 112 sends a spray gun control signal through line 113 to a can index controller 114 when the spray gun is cycled on at the start of every spray coating cycle. The can index controller 114 counts the number of cans sprayed and allows an operator to select a cleaning spray cycle to occur after every can or up to every fifteenth can or more. After the selected number of cans, the can index controller 114 sends a signal through line 115 to a wash spray request latch 116.

Once the clean spray request is latched in controller 116, a signal is sent via line 117 to a wash delay timer control 128. Timer control 128 allows for a delay of a first predetermined period of time of about 1 to 15 milliseconds or more and preferably about 5 to about 15 milliseconds before the clean spray begins. This time delay allows the coating spray to completely stop before the cleaning spray begins. Typically, the timer 128 control is clocked by a 1 millisecond time base signal through line 129 from the signal generator 130. After the first predetermined period of time, control 128 sends a signal through line 131 to washer timer control 132.

Wash timer control 132 opens the clean spray gun a second predetermined period of time for about 1 to about 255 milliseconds or more and preferably about 5 to 35 milliseconds and more preferably about 10 to 15 milliseconds. The controller 132 is clocked by a 1 millisecond time base signal through line 133 from the signal generator 130.

The clean spray gun 24 is opened by solenoid 140 which is driven by the signal on line 138 from output drive system 136, which is in turn driven by the signal on line 137 from timer control 132. This allows cleaning solution 29 to spray out of the cleaning spray nozzle 28 onto the spray nozzle 20 for the second predetermined period of time. Accordingly, oversprayed coating material collecting on the tip of the nozzle 20 is continually washed off and the nozzle 20 is kept clean. This avoids any adverse effects from the coating material accumulating on the nozzle.

In addition to cycling on the wash spray by means of can index controller 114, when necessary, the wash spray can be cycled on manually by a push button represented by manual control 118. When the button is pushed, a signal is sent down line 119 to latch 116 and from latch 116 down line 117 to initiate a clean spray cycle. This enables the spray nozzle to be washed at any desired time, such as at the startup of the system to insure that the nozzle 20 is clean.

A unique aspect of the control system 31 is the watch dog controller 120 which is the third way of initiating a clean spray cycle. If there are no clean sprays within a third predetermined period of time, such as about 5 seconds, controller 120 will automatically initiate a clean spray cycle by sending a signal along the line **120*a* to wash spray request latch 116 which will in response initiate a clean spray cycle by sending a signal down line 117. This is particularly important at the end of a manufacturing cycle when less than the preset number of cans set at can index controller 114 have been coated. Watch dog controller 120 thereby prevents any coating material on the spray nozzle 20 from drying and interfering with the spray pattern during the next cycle of operation. Watch dog timer control 120 is reset every time the coating gun cycles on by means of a signal through line 121**.

Regardless of which of the three methods is used for initiating a clean spray cycle, timers 128 and 132 are reset in the same fashion. First, upon receiving a signal on line 117, wash delay timer 128 starts to count down, and when its count reaches zero, the clock input port from clock generator 130 is disabled. Next, wash timer 132 starts its count, and likewise, when its count reaches zero, its clock input port is disabled. Also, at this time a signal is sent on line 122 to reset latch 116. In response to that signal, latch 116 sends signals down lines 123, 124 and 125 to reset controllers 114, 118 and 120, respectively, and sends a signal down lines 134 and 135 to reload the counts into timers 134, 135 and to enable the clock input ports to accept clock pulses received from signal generator 130. Timers 128 and 132 are non ready for the initiation of the next clean spray cycle by means of the next signal down line 117.

Another novel feature of the control system is that a signal on line 200 is present whenever the coating gun solenoid is energized to open the coating gun. The signal on line 200 resets latch 116, in the same fashion as the signal on line 122 resets latch 116. Thus, in response to the signal on line 200, latch 116 immediately resets timers 128 and 132 to terminate any clean spray cycle which may be in process. This prevents the cleaning gun from spraying cleaning solution onto the coating gun nozzle while a can is being coated.

The patents referenced herein are intended to be incorporated in their entireties by reference hereto.

As can now be appreciated from the above description, there has been provided in accordance with this invention an apparatus and method for covering a coating gun and an associated cleaning gun with respective spray gun covers to protect them from overspray, as well as a system for spraying a cleaning solution onto a coating gun spray nozzle to satisfy the objects and advantages set forth above. The invention not only quickly, easily and inexpensively covers the forward portions of the coating and cleaning guns with spray gun covers to protect them from overspray, but in addition, periodically cleans the forward most portion of the gun which is not so covered, namely the nozzle, with cleaning solution so that the coating system provided is impaired to the least extent possible by oversprayed coating material, substantially automatically, with a minimum of operator intervention and labor required.

While the invention has been described in combination with embodiments thereof, it is evident that many alternatives, modifications, and variations will be apparent to those skilled in the art in light of the foregoing description. Accordingly, it is intended to embrace all such alternatives, modifications and variations as fall within the spirit and scope of the appended claims.

Thus having described the invention, what is claimed is:

1. A cover sleeve adapted for being removeably received on a spray gun having a spray gun extension, and a spray nozzle secured to an outlet end of said gun extension by a nozzle nut, said cover sleeve comprising:

an elongated tubular body defining an internal passage adapted to be in surrounding relationship with said gun extension, said tubular body including:

an annular inlet portion with a first internal diameter having a flange extending radially outward and being adapted to shield a rearward portion of said spray gun from overspray;

an annular intermediate portion with a second internal diameter less than said first diameter adapted for being in frictional engagement with said nozzle nut; and an annular outlet portion with a third internal diameter less than said second diameter adapted for being in liquid-tight sealing engagement with said nozzle nut.

2. The cover sleeve of claim 1 wherein said tubular body has a generally uniform wall thickness.

3. The cover sleeve of claim 2 wherein said tubular body preferably has a uniform wall thickness of about 0.020 to about 0.040 inches.

4. The cover sleeve of claim 2 wherein said tubular body more preferably has a uniform wall thickness of about 0.027 to about 0.033 inches.

5. The cover sleeve of claim 1 wherein said annular outlet portion of said tubular body is adapted to be pressed axially onto said nozzle nut to form a liquid-tight seal therebetween.

6. The cover sleeve of claim 5 wherein said annular outlet portion has an inwardly curved lip having a free end defining said third diameter.

7. The cover sleeve of claim 1 wherein said tubular body comprises a material selected from the group comprising polyethylene and polypropylene.

8. The cover sleeve of claim 1 wherein said third internal diameter is that of an open end of said sleeve adapted to be pressed against a cylindrical surface of said nozzle nut.

* * * * *

UNITED STATES PATENT AND TRADEMARK OFFICE
Certificate

Patent No. 5,405,087 Patented: April 11, 1995

On petition requesting issuance of a certificate for correction of inventorship pursuant to 35 U. S. C. 256, it has been found that the above-identified patent, through error and without deceptive intent, improperly sets forth the inventorship.

Accordingly, it is hereby certified that the correct inventorship of this patent is: Joseph C. Waryu, Amherst, Ohio; Thomas A. Loparo, Elyria, Ohio; Guy H. McMillan, Elyria, Ohio; and Mark W. Novotny, Avon Lake, Ohio.

Signed and Sealed this Third Day of March, 1998.

KAREN M. YOUNG
*Supervisory Patent Examiner*
Art Unit 3617